US010997950B1

(12) United States Patent
Tenthorey et al.

(10) Patent No.: US 10,997,950 B1
(45) Date of Patent: May 4, 2021

(54) HAND-HELD ANALOG SIGN

(71) Applicant: Oat Foundry LLC, Philadelphia, PA (US)

(72) Inventors: Luc Tenthorey, Philadelphia, PA (US); Michael Xavier Courtney, Philadelphia, PA (US); John Halko, IV, Philadelphia, PA (US); James Michael Vescio, Jr., Philadelphia, PA (US); Sarah van Bemmel, Philadelphia, PA (US)

(73) Assignee: Oat Foundry, LLC, Philadelphia, PA (US)

( * ) Notice: Subject to any disclaimer, the term of this patent is extended or adjusted under 35 U.S.C. 154(b) by 0 days.

(21) Appl. No.: 16/930,349

(22) Filed: Jul. 16, 2020

(51) Int. Cl.
*G09G 5/24* (2006.01)

(52) U.S. Cl.
CPC ..... *G09G 5/24* (2013.01); *G09G 2354/00* (2013.01)

(58) Field of Classification Search
CPC ..... G09G 5/24; G09G 2354/00; G06F 3/02; G06F 3/011
See application file for complete search history.

(56) References Cited

U.S. PATENT DOCUMENTS

2012/0050970 A1* 3/2012 Murakata ..... G06F 1/1613 361/679.01

FOREIGN PATENT DOCUMENTS

KR 101504565 B1 * 3/2015

* cited by examiner

*Primary Examiner* — Robert J Michaud
(74) *Attorney, Agent, or Firm* — Joseph E. Maenner; Maenner & Associates, LLC

(57) ABSTRACT

A hand-held display device includes a container having a front display having a perimeter, a top side, a left side, a right side, and a bottom side, together all defining the perimeter of the front display, and a back side. The front display includes a plurality of display portions. Each display portion provides an array of display markers. The display markers are configured to display a first side when an electrical current is passed therethrough and a second side when the electrical current is not passed therethrough. A plurality of controllers is mounted on the container. The plurality of controllers equals the plurality of display portions. Each controller is configured to selectively pass the electrical current through a predetermined configuration of the display markers in a respective one of the first plurality of display portions, such that a predetermined indicia is displayed.

19 Claims, 15 Drawing Sheets

HAND-HELD ANALOG SIGN

BACKGROUND OF THE INVENTION

Field of the Invention

The present invention relates to hand-held analog signs that can be modified by adjusting control dials.

Description of the Related Art

The National Football League ("the League") is a multi-billion dollar annual enterprise. The League has drafted certain rules about how player on the field can receive communications from the sidelines between plays. One of the rules restricts the use of electronic signage. This has resulted in the use of large pre-printed signs that are cumbersome and prone to weather damage when used in rain/snow.

It would be beneficial to be able to provide a device that enables communication from the sidelines with players on the field without the use of electronic signage.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a hand-held display that includes a container having a front display having a perimeter, a top side, a left side, a right side, and a bottom side, together all defining the perimeter of the front display, and a back side. The front display includes a plurality of display portions. Each display portion provides an array of display markers. The display markers are configured to display a first side when an electrical current is passed therethrough and a second side when the electrical current is not passed therethrough. A plurality of controllers is mounted on the container. The plurality of controllers equals the plurality of display portions. Each controller is configured to selectively pass the electrical current through a predetermined configuration of the display markers in a respective one of the first plurality of display portions, such that a predetermined indicia is displayed.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
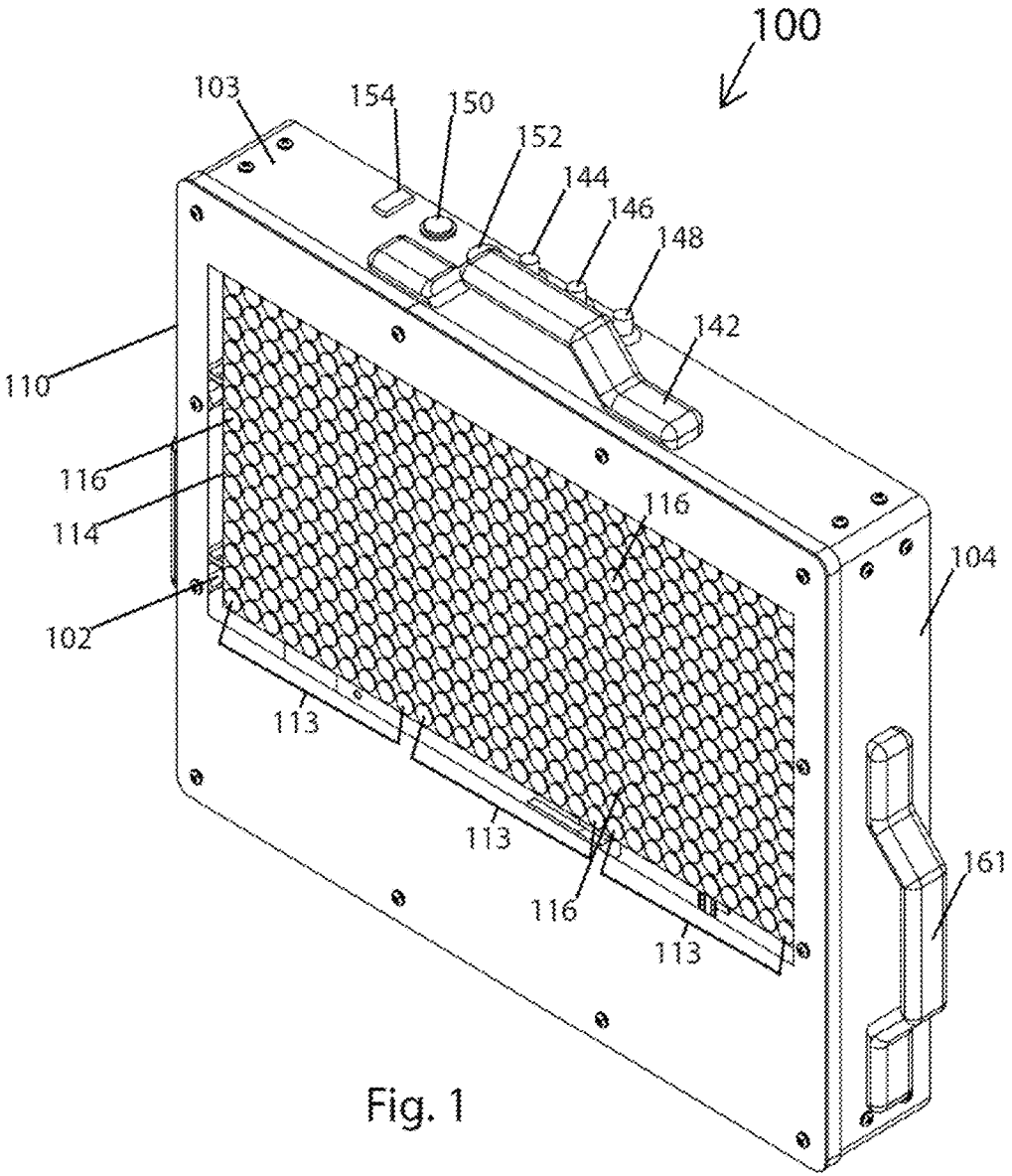
FIG. 1 is a perspective view of a hand-held analog sign according to a first exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The word "about" is used herein to include a value of +/−10 percent of the numerical value modified by the word "about" and the word "generally" is used herein to mean "without regard to particulars or exceptions."

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

The present invention provides a hand-held enclosure that can be used to display indicia that is viewable to a person from a significant distance, such as at least about 150 feet. In an exemplary embodiment, the hand-held device can be used to transmit visible indicia to football players on a football field, such that the indicia represents a code for a particular play to be run by the players.

Referring to FIGS. 1-12 an exemplary hand-held display sign, or device, 100 ("display device 100") according to the present invention includes a container 110 that is approximately the size of a small briefcase. In an exemplary embodiment, container 110 is generally parallelepiped in shape and has dimensions of about 19 inches long, about 15 inches high, and about 3¼ inches deep. In an exemplary embodiment, display device 100 weighs about 8 lbs. Container 110 can be constructed from carbon fiber, or other sturdy, lightweight material.

Container 110 includes a front display 102 having a perimeter and a top side 103, a left side 104, a right side 105, and a bottom side 106, together all defining the perimeter of the front display 102. Container 110 also includes a back side 108.

Figure 2:
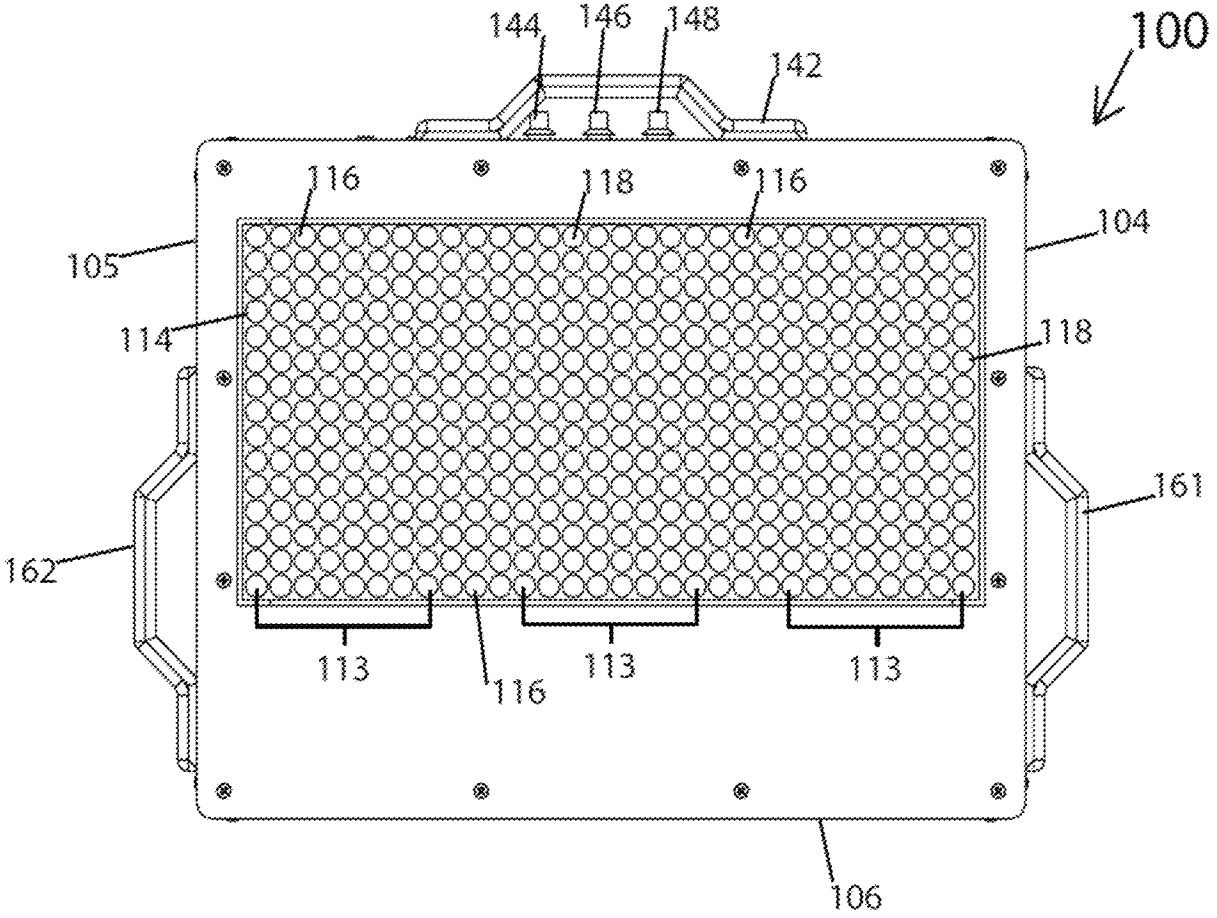
FIG. 2 is a front elevational view of the sign of FIG. 1.
Figure 3:
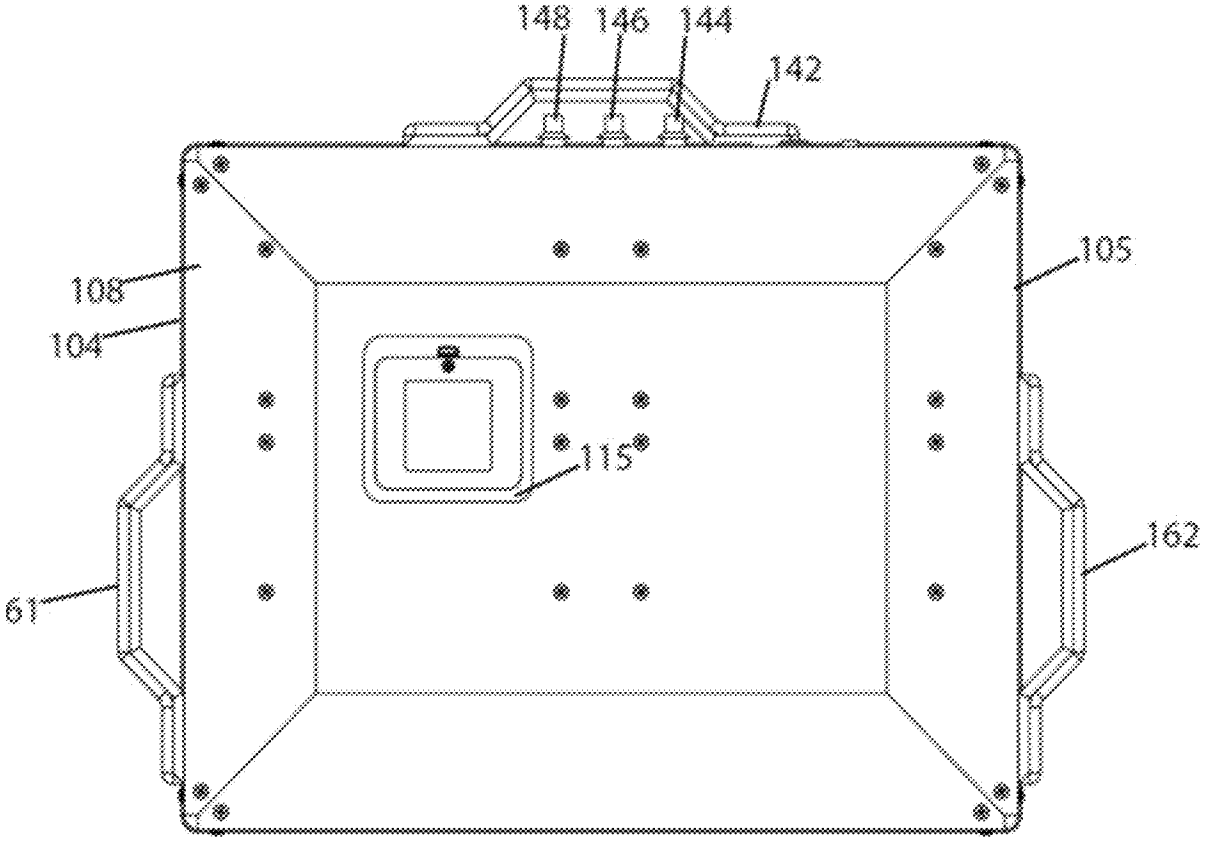
FIG. 3 is a rear elevational view of the sign of FIG. 1.
Figure 4:
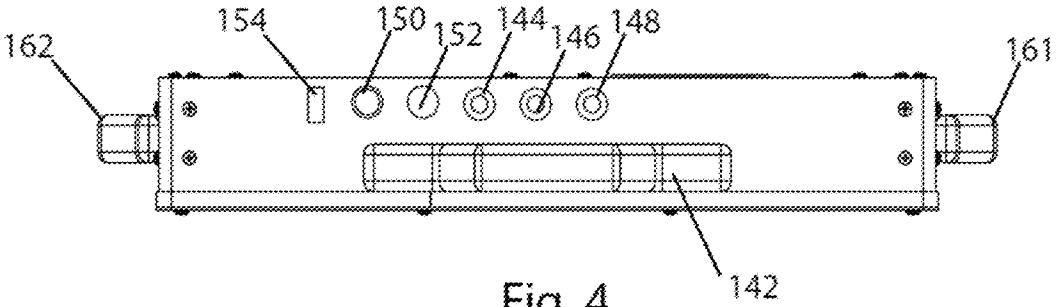
FIG. 4 is a top plan view of the sign of FIG. 1.
Figure 5:
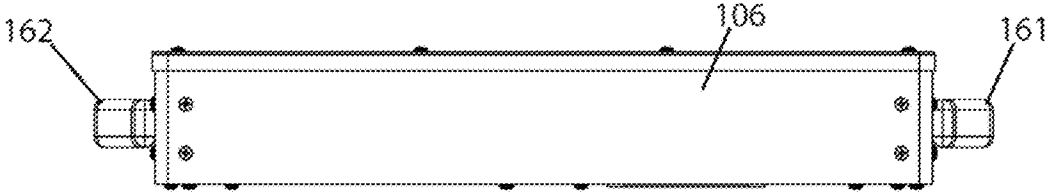
FIG. 5 is a bottom plan view of the sign of FIG. 1.

Referring to FIG. 2, front display 102 comprises an array having a plurality of display portions 114. In an exemplary embodiment, three display portions 114 are provided adjacent to each other.

Figure 9:
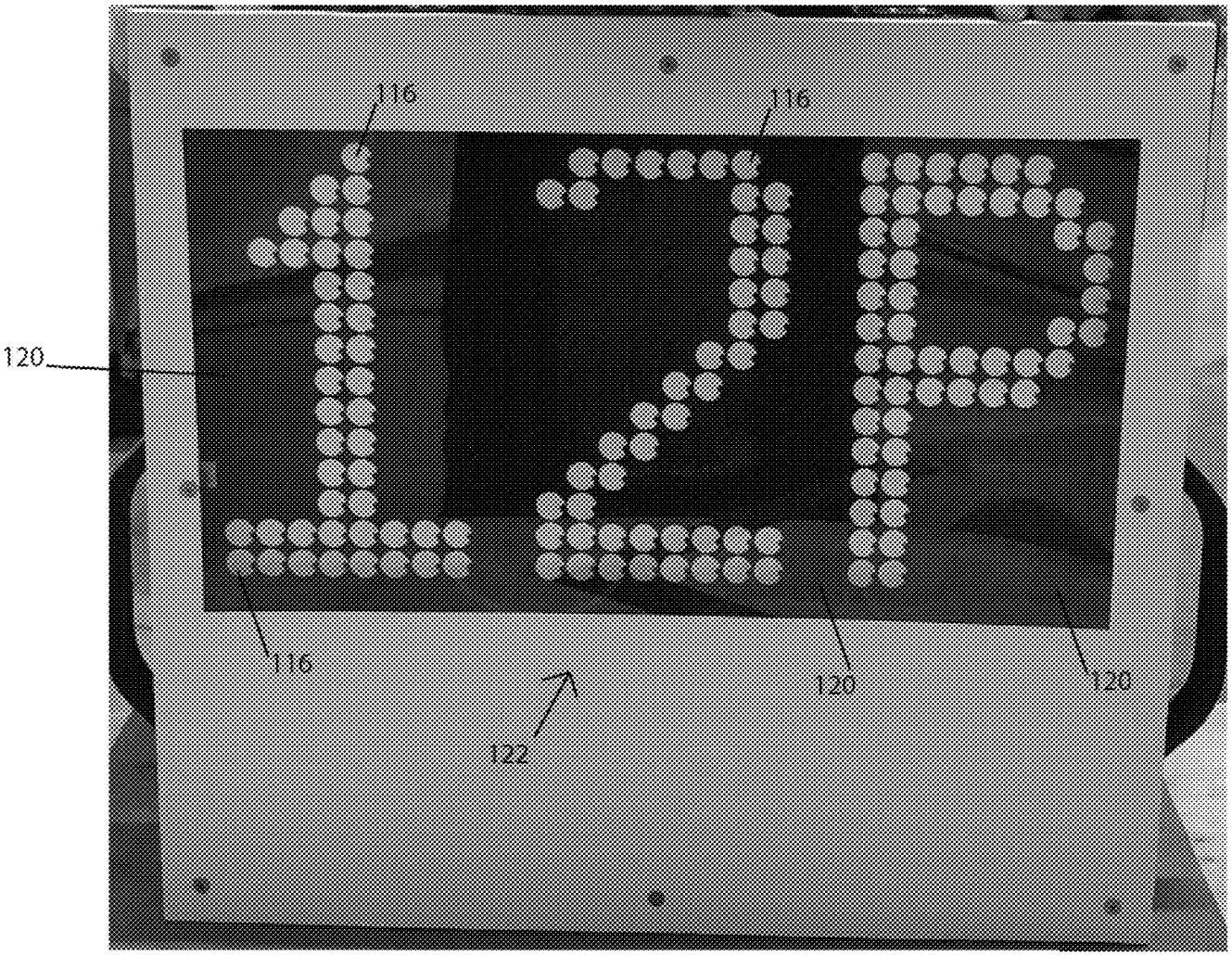
FIG. 9 is a front elevational view of the sign of FIG. 1 with display indicia shown.

Each display portion 114 includes an array 113 of display markers 116. In an exemplary embodiment, display markers are manufactured by AlfaZeta, of Łódź, Poland. Display markers 116 are configured to display a first side 118 when an electrical current is not passed therethrough and a second side 120 when the electrical current is passed therethrough. In an exemplary embodiment, a shown in FIG. 2, first side 118 can be white, while, as shown in FIG. 9, second side 120 can be black or other highly contrasting color, such as bright yellow. The extreme contrast in colors between first side 118 and second side 120 provide a contrast between display markers 116 showing first side 118 versus adjacent display markers 116 showing second side 120 so that indicia 122 formed by displaying second side 120 can easily been seen from a distance, even in direct sunlight.

In an exemplary embodiment, display portion 112 is comprised of an array 113 of 14 high×28 wide lightweight display markers 116, each mounted on its own axis of rotation, and controlled via an array of magnets below each marker 116. In an exemplary embodiment, each display marker 116 is ½" in diameter. When a small magnetic field is applied or removed from each location in the grid, markers 116 can flip quickly between first side 118 and second side 120.

Figure 10:
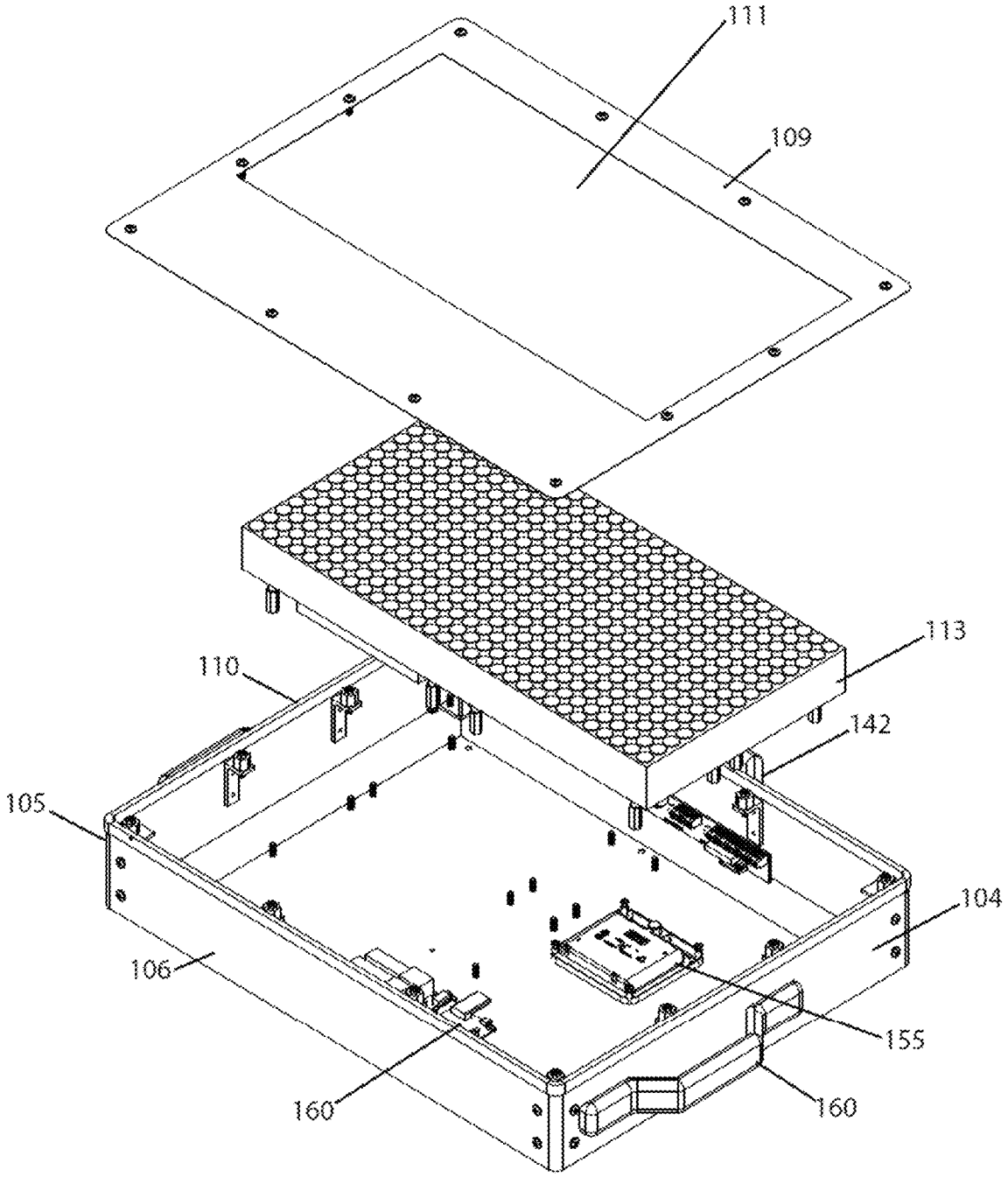
FIG. 10 is an exploded view of the sign of FIG. 1.
Figure 11:
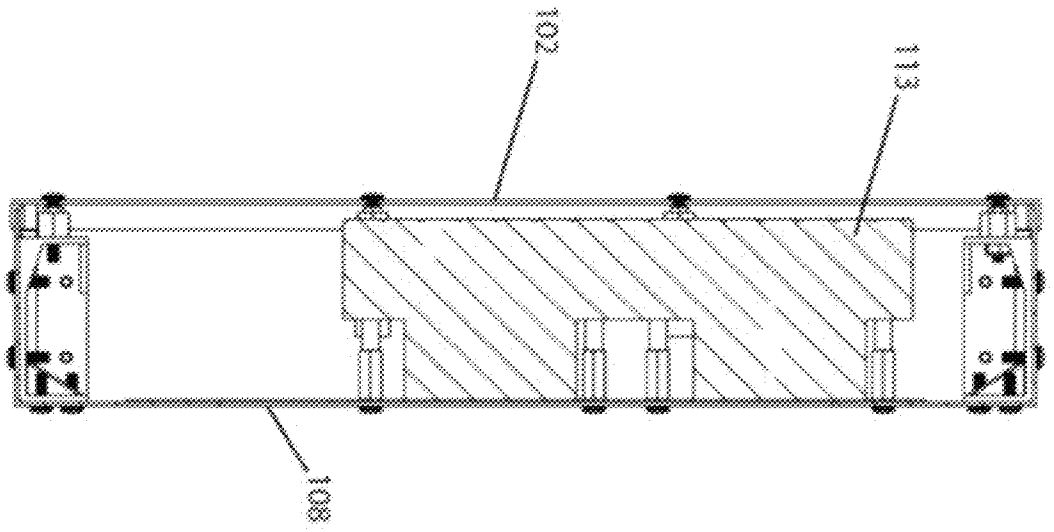
FIG. 11 is a sectional view of the sign of FIG. 1.

A polycarbonate face 109, shown in FIG. 10, covers front display 102. Face 109 has a cutout portion 111 to expose array 113 of display markers 116.

Container 110 also includes top side 103 that includes a first handle 142 extending upwardly from top side 140. First handle 142 allows a user to easily carry display device 100 in one hand or to hold display device 100 while operating a control.

Figure 8:
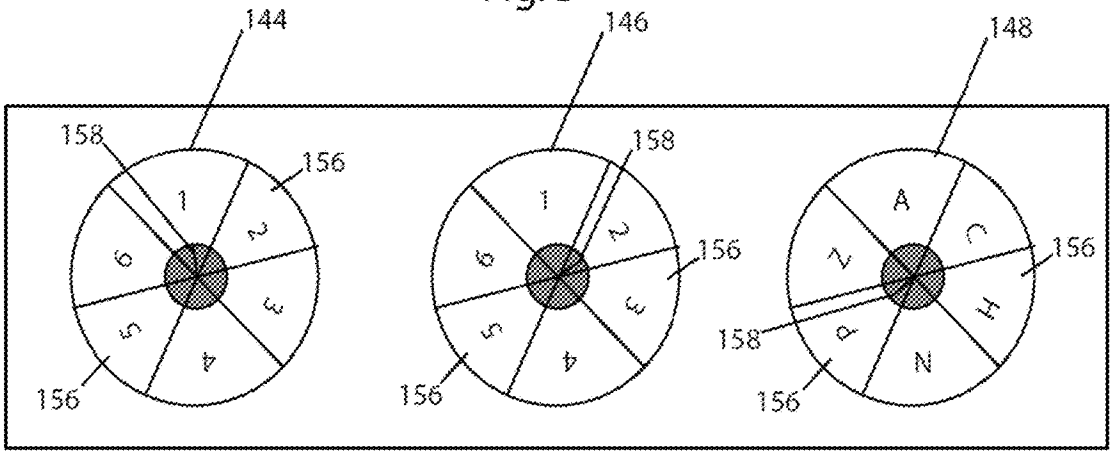
FIG. 8 is a top plan view of controls used with the sign of FIG. 1.
Figure 7:
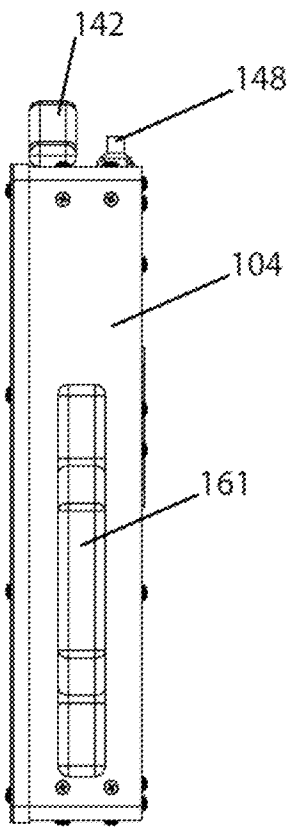
FIG. 7 is a left side elevational view of the sign on FIG. 1.
Figure 6:
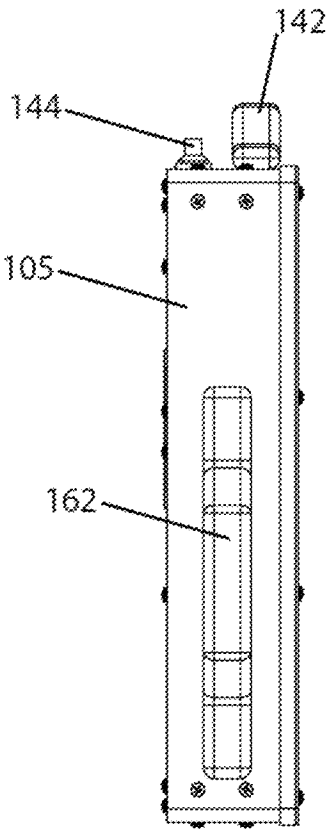
FIG. 6 is a right side elevational view of the sign of FIG. 1.

Referring to FIGS. 1, 2, 4, and 12, a control system including three controllers 144, 146, 148, a "SEND" button 150, an LED indicator 152, and a power switch 154 are mounted on top side 140. Those skilled in the art, however, will recognize that any of portions or all of the control system can be mounted on other sides. Referring to FIG. 8, each controller 144, 146, 148 has a plurality of indicia 156 printed therearound and a pointer 158 printed thereon, such that, when a respective controller 144, 146, 148 is rotated, pointer 158 points to a discrete one of the indicia 156. Three controllers 144, 146, 148 are provided to equal the number of different display portions 114.

As shown in FIG. 8, controllers 144, 146 include identical indicia 156, while control 148 includes different indicia 156. Those skilled in the art will recognize that all of controllers 144, 146, 148 can include identical indicia 156, or different indicia 156. Also, as shown in the Figures, controllers 144, 146, 148 are knobs, but those skilled in the art will recognize that controllers 160 can be other than knobs.

Figure 12:
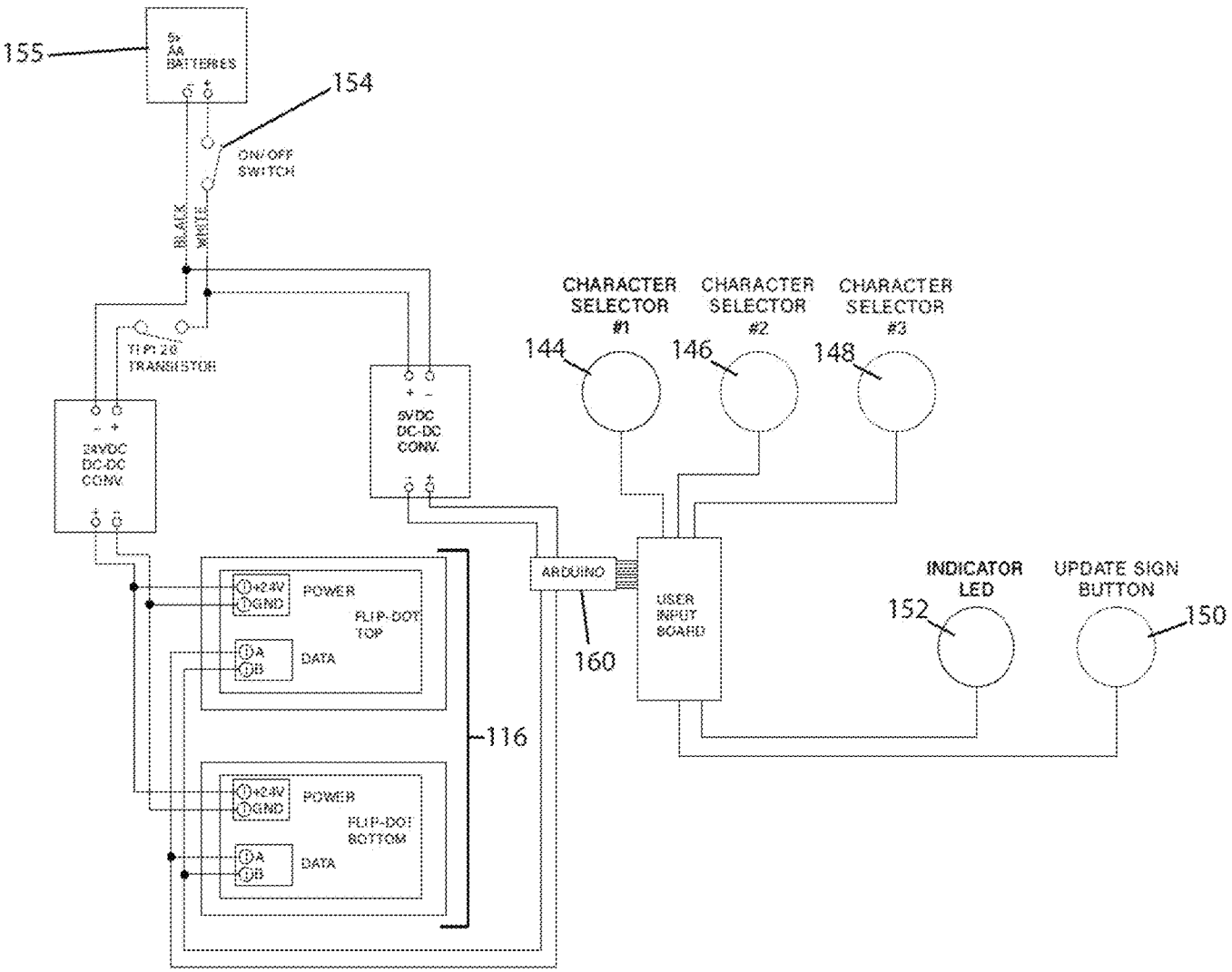
FIG. 12 is an exemplary electrical schematic drawing for the sign of FIG. 1.
Figure 13:
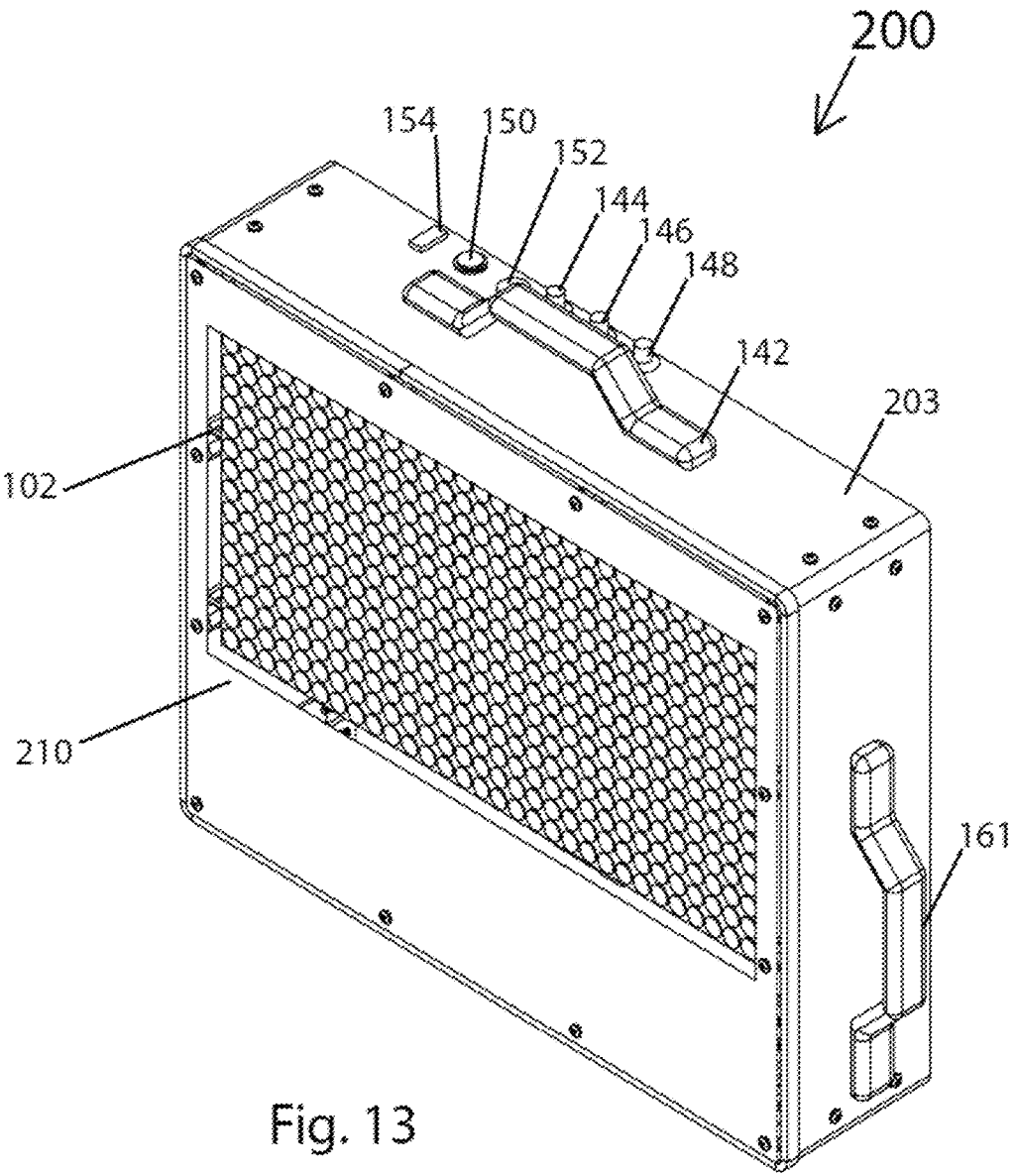
FIG. 13 is a perspective view of a hand-held analog sign according to a second exemplary embodiment of the present invention.
Figure 14:
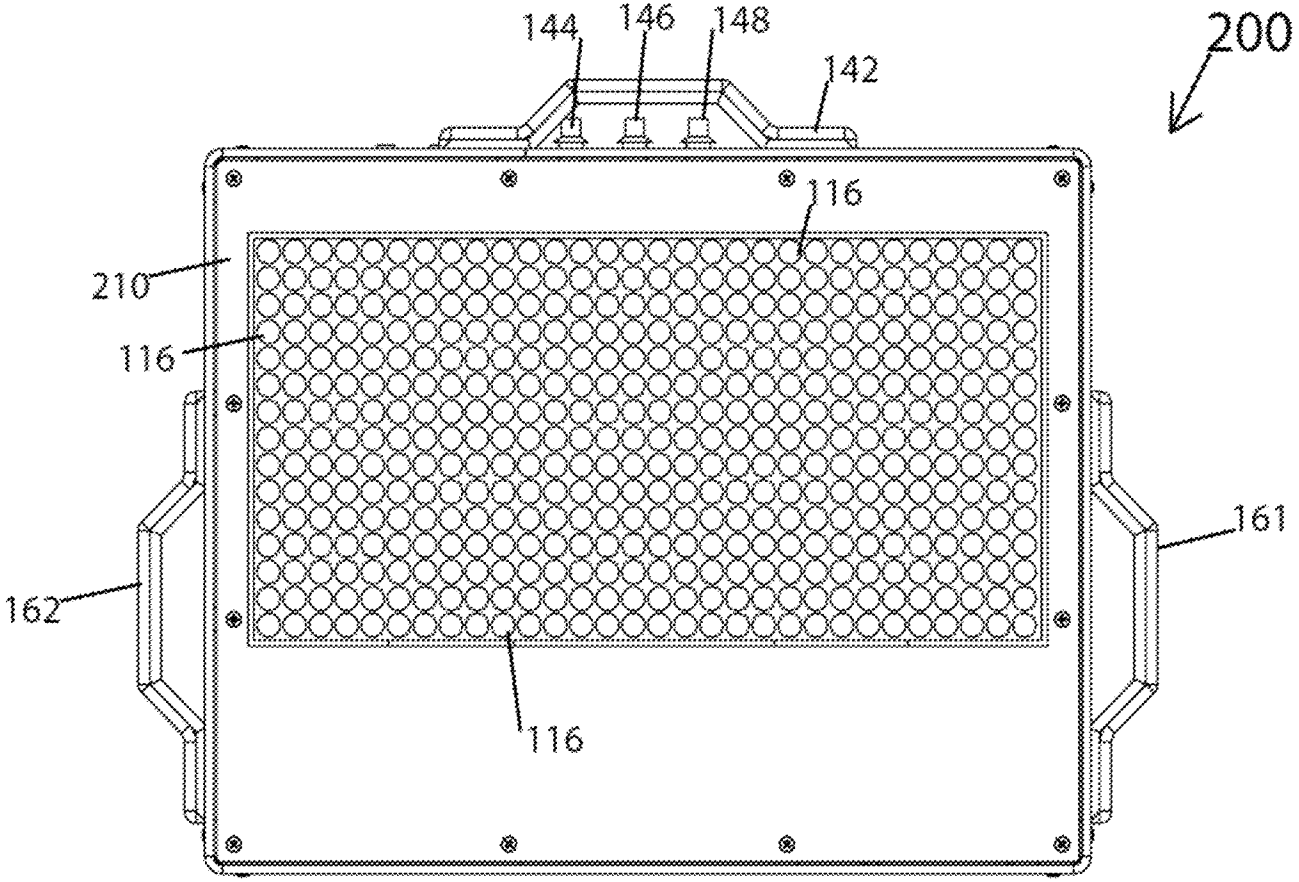
FIG. 14 is a front elevational view of the sign of FIG. 13.
Figure 15:
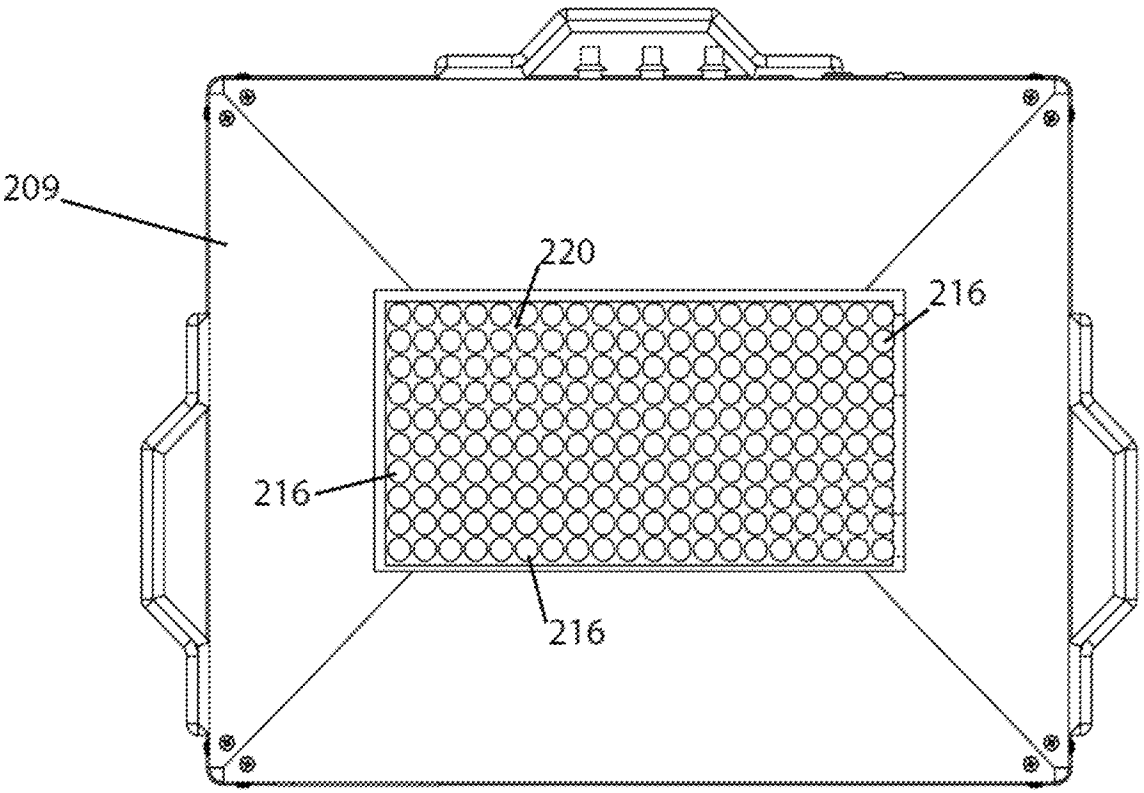
FIG. 15 is a rear elevational view of the sign of FIG. 13.
Figure 16:
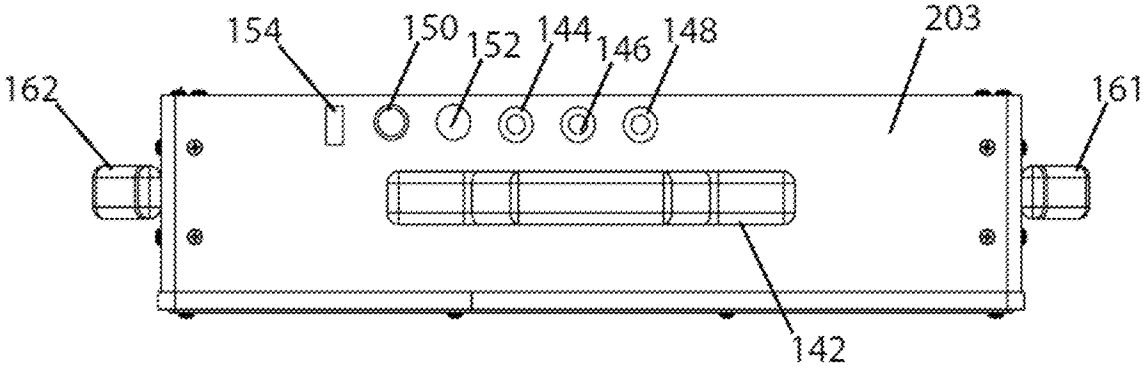
FIG. 16 is a top plan view of the sign of FIG. 13.
Figure 17:
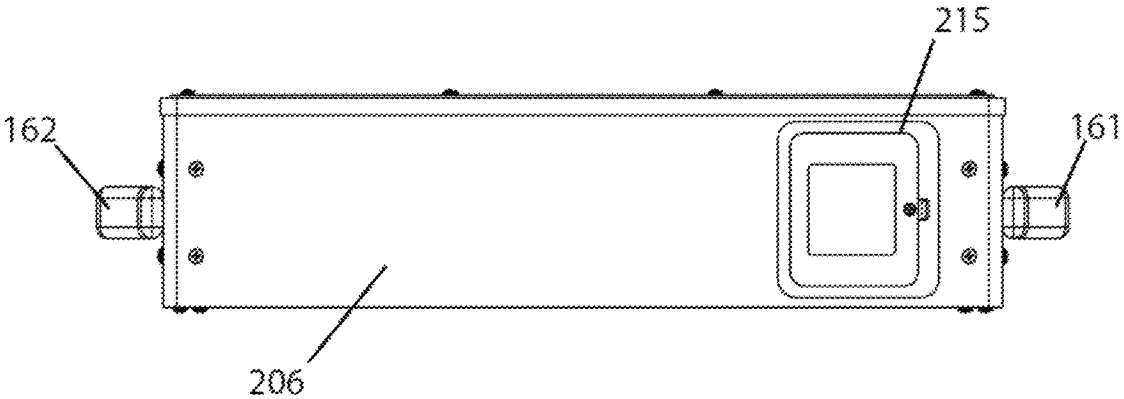
FIG. 17 is a bottom plan view of the sign of FIG. 13.
Figure 19:
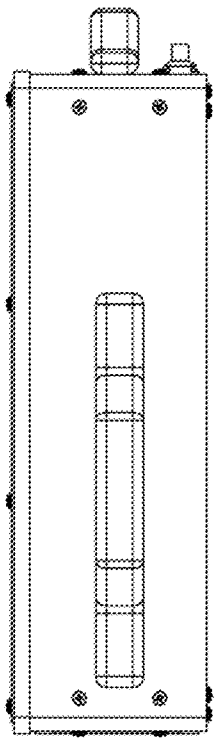
FIG. 19 is a left side elevational view of the sign on FIG. 13.
Figure 18:
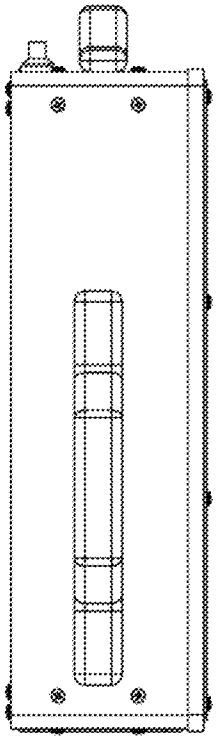
FIG. 18 is a right side elevational view of the sign of FIG. 13.

A display control 160, shown in FIG. 10 and schematically in FIG. 12, is electronically connected to each controller 144, 146, 148 such that, when the pointer 158 points to the discrete one of the indicia 156, an electronic signal is transmitted to controller 160 such that controller 160 in turn selectively transmits an electrical signal to predetermined display markers 116 to generate a magnetic field at each of predetermined display markers 116 corresponding to the respective controller 144, 146, 148 are configured to display the indicia 156 on array 113. By way of example only, when controller 144 has pointer 158 pointing to "1", controller 146 has pointer 158 pointing to "2", and controller 148 pointing to "P", as shown in FIG. 8, display markers 116 are configured to display "12P" on array 113, as shown in FIG. 9.

Referring to FIG. 10 and the electrical schematic of FIG. 12, power switch 154 is used with a power supply 155 to power display control 160 and the magnets that are used to flip display markers 116. Additionally, "SEND" button 150 is electronically connected to the plurality of controllers 144, 146, 148 wherein, when "SEND" button 150 is activated, display markers 116 are configured to display the predetermined indicia 156. A visual indicator in the form of LED indicator 152 is configured to illuminate to indicate that "SEND" button 150 transmitted a signal to configure display markers 116 to display the predetermined indicia 156. Back side 108 can be fitted with a removable battery cover 115 to allow for easy installation and removal of batteries 155.

Referring to FIGS. 1-7, left side 104 includes a second handle 160 extending outwardly therefrom and right side 105 includes a third handle 162 extending outwardly therefrom.

To use display device 100, an operator wishing to send signals to the field must first switch on power switch 154, after which the LED indicator 152 will give a quick flash to ensure the user that display device 100 is "ON". The operator adjusts controllers 144, 146, 148 to choose the combinations of indicia 156 to display on front display 102, which can be uniquely configured to any secret code or combination of symbols a team would desire.

With the three unique entries chosen via controllers 144, 146, 148, the operator then hits the SEND button 150, and corresponding display markers 116 rotate between first side 118 and second side 120 so that the desired indicia 122 formed by displaying second side 120 are visible. After desired indicia 122 is formed, LED indicator 152 lights up to let the operator know that the signal has been sent to front display 102 and that indicia 122 is shown on front display 102. This makes operating display device 100 easy, as the operator does not have to flip container 110 around to see that front display 102 has been updated; the operator simply grasp handles 160, 162 and raises display device 100 above his/her head to display indicia 122 to players on the field.

When not switching display markers 116, display device 100 uses very little electrical power at resting state, so display device 100 can be switched on for about 20 hours of operation. When needing to switch out batteries 155, batteries 155 can be accessed from back side 108 without needing to open front display 102.

In an alternative exemplary embodiment, a hand-held display device 200 ("display device 200") is shown in FIGS. 13-19. Display device 100 is similar to display device 100, but overall depth of display device 200 is increased by roughly 40% over the depth of display device 100, a clear polycarbonate cover is installed and epoxied into place at the back of display device 200, and an external battery cover 215 is removably mounted on the bottom face 206 of display device 200.

Display device 200 operates similarly to display device 100 described above but, in addition, display device 200 further includes a confirmation display. The confirmation display can be back display 220 mounted on a back side 209 of a container 210 configured to display the first indicia 156 (e.g., FIG. 2) when back display markers 216 are configured to display the first indicia 156 and configured to display the second indicia (e.g., FIG. 9) 122 when the back display markers 216 are configured to display second indicia 256.

Figure 20:
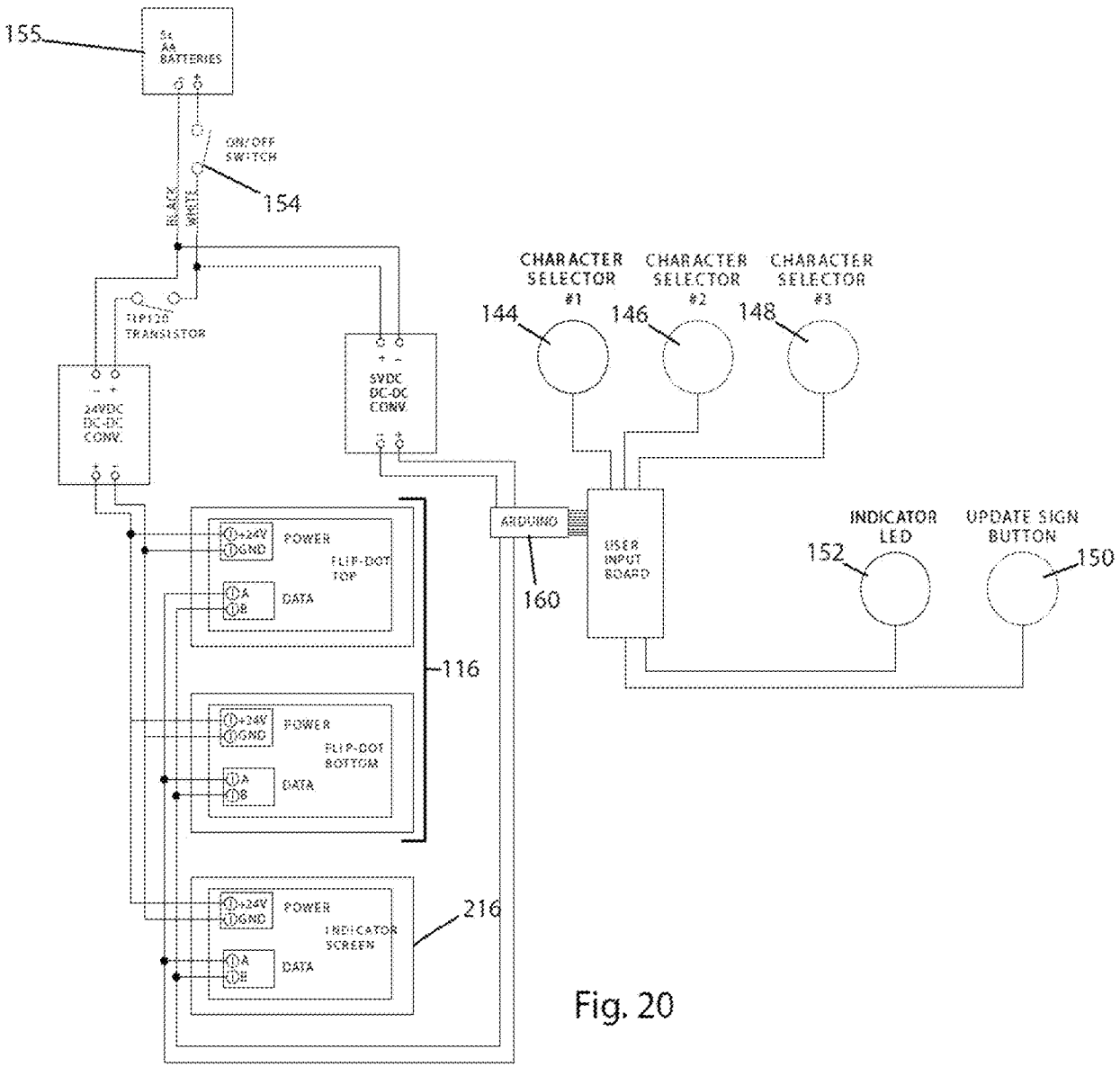
FIG. 20 is an exemplary electrical schematic drawing for the sign of FIG. 13.

Back display markers 216 are identical to display markers 116 and are activated simultaneously with the activation of display markers 116 such that the back indicia 256 is a smaller version of the first indicia 156. Back display markers 216 electronically connected to the controllers 144, 146, 148 wherein each controller 144, 146, 148 is configured to selectively pass the electrical current through a predetermined configuration of the back display markers 216 in the same way as display markers 116, as provided by the electrical schematic of FIG. 20.

As indicia 156 are selected and controlled via controllers 144, 146, 148 at the top face 203 of display device 200, the indicia 156 can be relayed to front display 102 and indicia 256 can be relayed to back display 220. In this way, the user can visually observe the indicia 256 that have been selected for the next play without having to turn the display around to observe the front indicia 156. This visual confirmation can be much faster in observing any mistakes that might have been made during the play call and provide a high level of confidence in the call before display device 200 is lifted for use.

It will be further understood that various changes in the details, materials, and arrangements of the parts which have been described and illustrated in order to explain the nature of this invention may be made by those skilled in the art without departing from the scope of the invention as expressed in the following claims.

We claim:

1. A hand-held display device comprising:

a container having:

a front display having a perimeter;

a top side, a left side, a right side, and a bottom side, together all defining the perimeter of the front display; and a back side;

the front display comprising a plurality of display portions, each display portion comprising an array of display markers, the display markers configured to display a first side when an electrical current is passed therethrough and a second side when the electrical current is not passed therethrough; and a plurality of controllers mounted on the container, the plurality of controllers equaling the plurality of display portions, each controller configured to selectively pass the electrical current through a predetermined configuration of the display markers in a respective one of the first plurality of display portions, such that a predetermined indicia is displayed.

2. The hand-held display device according to claim 1, wherein the container has a generally parallelepiped shape.

3. The hand-held display device according to claim 1, further comprising a first handle extending upwardly from the top side.

4. The hand-held display device according to claim 3, further comprising a second handle extending outwardly from the left side and a third handle extending outwardly from the right side.

5. The hand-held display device according to claim 1, wherein the first plurality of controllers are mounted on the top side.

6. The hand-held display device according to claim 1, wherein the array comprises a number of display markers extending vertically and twice the number of display markers extending horizontally.

7. The hand-held display device according to claim 1, wherein each of the plurality of controllers has a plurality of indicia printed therearound and a pointer printed thereon, such that, when the controller is rotated, the pointer points to a discrete one of the indicia.

8. The hand-held display device according to claim 7, wherein, when the pointer points to the discrete one of the indicia, the display markers on the display portion corresponding to the controller are configured to display the indicia.

9. The hand-held display device according to claim 1, wherein the indicia displayed on a first display portion is different than the indicia displayed on a second display portion.

10. The hand-held display device according to claim 1, further comprising a transmit button electronically connected to the plurality of controllers wherein, when the transmit button is activated, the display markers are configured to display the predetermined indicia.

11. The hand-held display device according to claim 10, further comprising signal confirmation light configured to illuminate to indicate that the transmit button transmitted a signal to configure the display markers to display the predetermined indicia.

12. The hand-held display device according to claim 1, further comprising:

a back display mounted on the back side, the back display comprising a plurality of back display portions, each back display portion comprising an array of back display markers, the back display markers configured to display a first back side when an electrical current is passed therethrough and a second back side when the electrical current is not passed therethrough, the back display markers electronically connected to the controllers wherein each controller is configured to selectively pass the electrical current through a predetermined configuration of the back display markers in a respective one of the first plurality of back display portions, such that a back predetermined indicia is displayed.

13. The hand-held display device according to claim 12, wherein the back predetermined indicia is a smaller version of the predetermined indicia.

14. A hand-held display comprising:

a container;

a display mounted on a front side of the container, the display comprising a plurality of display markers having a first side, the first side being a first color and having a second side, the second side being a second color, different from the first color;

a controller configured to rotate the display markers such that, when the controller is in a first position, the display markers are configured to display a first indicia and, when the controller is in a second position, the display markers are configured to display a second indicia.

15. The hand-held device ing to claim 14, wherein the display markers are grouped into a plurality of arrays and wherein the controller is configured to only rotate the display markers in one of the plurality of arrays.

16. The hand-held display device according to claim 14, wherein the first and second indicia are each printed adjacent to the controller.

17. The hand-held display device according to claim 14, further comprising a visual indicator confirming that the display markers are displaying the second indicia.

18. The hand-held display device according to claim 14, further comprising a confirmation display mounted on a back side of the container, the confirmation display configured to display the first indicia when the display markers are configured to display the first indicia and configured to display the second indicia when the display markers are configured to display the second indicia.

19. The hand-held display device according to claim 18, wherein the confirmation display comprises a plurality of confirmation display markers having a first side, the first side being a first color and having a second side, the second side being a second color, different from the first color.

* * * * *